United States Patent [19]

Rosenthal

[11] Patent Number: 4,645,086

[45] Date of Patent: Feb. 24, 1987

[54] CLOSURE DEVICE FOR A CONTAINER

[75] Inventor: Karl-Heinz Rosenthal, Reichshof, Fed. Rep. of Germany

[73] Assignee: Bielsteiner Verschlusstechnik GmbH, Gummersbach, Fed. Rep. of Germany

[21] Appl. No.: 781,253

[22] Filed: Sep. 27, 1985

[30] Foreign Application Priority Data

Sep. 28, 1984 [DE] Fed. Rep. of Germany ..... 3435782

[51] Int. Cl.[4] ..... B67D 3/00

[52] U.S. Cl. ..... 215/235; 222/536

[58] Field of Search ..... 215/235; 222/556, 536, 222/545

[56] References Cited

U.S. PATENT DOCUMENTS 2,727,658 12/1955 Mart ..... 222/536 X
3,255,930 6/1966 Woodard .
3,516,581 6/1970 Micallef .
4,519,529 5/1985 Seltz ..... 222/536 X

FOREIGN PATENT DOCUMENTS 253614 11/1948 Switzerland .

OTHER PUBLICATIONS

EPO Publication 0111813 dated Jun. 27, 1984 Seaquist Closures Disc Top Dispensing Closures Publication.

*Primary Examiner*—Donald F. Norton
*Attorney, Agent, or Firm*—Dressler, Goldsmith, Shore, Sutker & Milnamow Ltd.

[57] ABSTRACT

A closure device for a container is described consisting of a cap for a container and a cap lid which is pivotably mounted on the cap. The cap lid has an encircling circumferential border which projects downwardly from the upper surface of the lid. The border is a curved spherical surface segment and the cap defines a cup-shaped recess which is complementary in shape to facilitate sealing. The center of curvature of the spherical surface segment is located on the pivot axis of the cap lid. A pair of supporting plates are formed on a base portion of the cap and are guided in the pivot plane of the cap lid by parallel guide ribs so that the cap is non-rotatably mounted and pivotably mounted reliably in the recess and is sealed in every operating position relative to the container cap.

19 Claims, 5 Drawing Figures

CLOSURE DEVICE FOR A CONTAINER

The invention relates to a closure device made of plastic for a container for free-flow substance, on which is attached a cap having a cover plate with a port, which cap has an upwardly open clearance, in which a closure part is pivotably mounted between a closing position and an opening position, one side of which closure part acts as actuating member and the other side is provided with a laterally opening outlet opening which, in the closing position of the closure part is closed under pretension by the upper edge of the clearance in the cap, with the closure part side used for actuation being located, in the closing position, at a distance above the cover plate forming the base of the clearance.

Closure devices of the abovementioned known generic type are either screwed onto the nozzle or the neck of the container by means of a screw thread or are connected by a click-stop closure to the container neck, with click-stop dogs gripping over corresponding projections on the outer side of the neck of the container, so that the closure device sits tightly on the container. The free-flowing substance which can be transferred by means of such closure devices can consist of fluids or small granular or spherical shaped particles such as, for example, fluids for personal hygiene, pills containing pharmaceutically active substances, granular, dried or liquid spices or foodstuffs such as, for example, ketchup. In the case of fluid substance especially, the fluid substance must be prevented from coming into contact with and being contaminated by foreign substances from the outside before it is used. Such closure devices, therefore, at the same time as having a pleasing appearance, must ensure that the container contents are reliably sealed to the outside. Moreover, such closure devices are mass produced articles, the economical manufacture of which must be ensured.

A closure device is known from the U.S. Pat. No. 3,516,581 (Micallof) which consists of a tipping lever which is tiltably mounted in an upper clearance of a cap at a distance above the cover plate of the cap. The lateral outlet opening in this lever is connected to a tube-like discharge pipe in the opening position of the tilting lever via a channel extending partially in this lever, which discharge pipe projects upward from the cover plate of the cap and forms the port for the container contents. This discharge pipe is closed at the underside of the tilting lever in the closing position of the latter by a sealing cap having a plug arranged therein. The tilting lever is provided with lateral roundedoff projections which engage into corresponding lateral recesses in the parallel opposite side walls of the clearance and form the pivot axis for the tilting lever. The lever arm for actuating the tilting lever by exerting a downwardly directed pressure by means of the finger of the operating person is shorter than the other lever arm of the tilting lever, which lever arm is allocated to the outlet opening, so that the forces exerted on the tilting lever are consequently unneccessarily high. Moreover, there is no guarantee that contaminants cannot get into the clearance of the cap under the lever-like closure and consequently come into contact with the container contents in the opening position of the closure and possibly even get into the container itself and/or prevent the unimpeded actuation of the closure. Finally, the form of the closure is extraordinarily complicated, so that comparatively high tool costs rise for the manufacture of the closure. A further disadvantage of this known closure is that the pretension for sealing the outlet opening in the closing position of the closure can only be achieved by the distance of the outlet opening from the perpendicular center axis of the sealing cap for the discharge pipe, which sealing cap is provided on the underside of the lever-like closure, being of a slightly larger size than the distance of this center axis from the cap wall of the clearance in the cap, which cap wall is located opposite the outlet opening in the closing position. Consequently, a pretension of the lever-like closure in the opening position develops between the cap wall of the clearance in the area of the outlet opening of the lever-like closure and the discharge pipe via the sealing cap at the underside of the closure, which pretension leads to increased friction between the closure and the associated parts of the cap and thus makes the pivoting of the lever-like closure in the opening position considerably more difficult.

In contrast, it is the object of the invention to improve a closure device of the known generic type mentioned at the beginning in such a way that the closure part reliably prevents the ingress of contaminants into the space between the closure part and the cap in every operating position of the closure part and ensures easy actuation of the closure part during constantly reliable sealing of the outlet opening in the closing position. Moreover, the closure device is to be as simple as possible in its construction, is to be producible with the least possible amount of material and is to have a pleasing appearance. Finally, the closure device is to be operationally reliable at any time.

This object is achieved according to the invention by the combination of features, wherein the closure part consists of a cap lid, wherein the cap lid, at its periphery, has an encircling border which projects downward and into the open clearance of the cap, wherein the outer surface of the border of the cap lid has the form of a disk-shaped, center spherical surface segment, the center of curvature of which is located on the pivot axis of the cap lid at half the height of the disk-shaped spherical surface segment, wherein the lateral outlet opening is located directly beneath the underside of the cap lid essentially in the upper half of the height of the lid border, wherein the encircling lid border is made elastic in the radial direction, wherein the cap wall, at the upper edge of the clearance, is provided with an encircling, undercut recess which is essentially formed in a cup shape corresponding to the lid border, wherein the cap lid, with its border is inserted in sealing manner with snap seating under radial pretension and pivotably guided in the corresponding cup-shaped recess of the cap wall, wherein support and pivot means are attached to the underside of the cap lid, by means of which support and pivot means the cap lid is supported non-rotatably and pivotably relative to the base of the clearance, and wherein stops are provided in the clearance, against which stops sits the cap lid in its closing or opening position.

The invention is described in greater detail below with reference to the schematic drawing, wherein.

The figures show closure devices which, as is known per se, can be screwed onto or placed onto the neck of a container (not shown), which neck surrounds the opening, by means of a screw thread or by means of click-stop device, which container is preferably made of plastic but can also be made of glass or metal. The container contains a free flowing substance, such as, for example, fluid, cream-like, granulated, powdery or similar substances which are used at the table, in the household or for cosmetic or industrial purposes.

Figure 1:
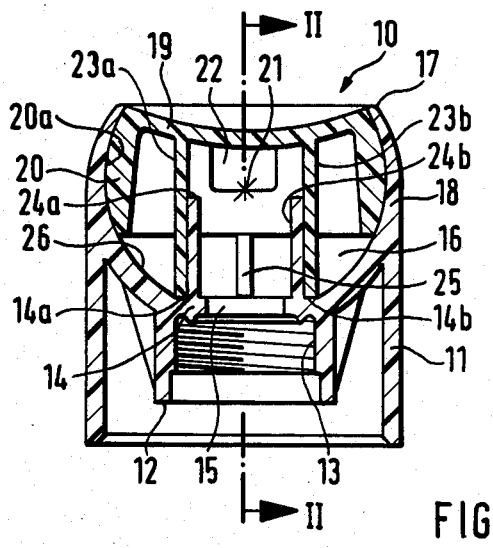
FIG. 1 shows a section, extending through the main cross section plane, along line I—I in FIG. 2 of a first embodiment of a closure device according to the invention.
Figure 2:
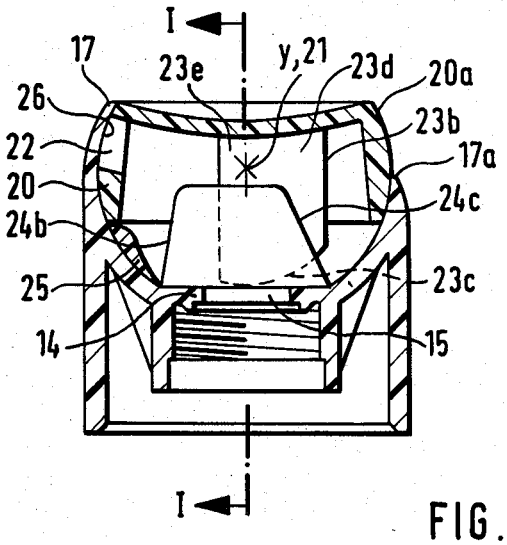
FIG. 2 shows a section along line II—II in FIG. 1 extending through the center longitudinal plane.

FIGS. 1 and 2 show a closure device 10, the closure cap 11 of which is provided with a coaxial mounting connection 12 which can be screwed tightly by an internal thread 13 onto a corresponding external thread on the container neck. In addition, it is of course also possible, in the case of containers made of plastic, to at the same time make the closure cap if necessary as an integral part with the container made of plastic, or to firmly connect the closure cap to the container in another way.

The closure cap 11 has a cover plate 14 which sits tightly on the opening of the container neck. In its center, the cover plate 14 has a port hole 15, through the center of which extends the main axis x of the closure device and through which the container contents can transfer into a clearance 16 in the closure cap 11, which clearance 16 is located above the cover plate 14. The cap wall 18 of the clearance 16 extending from the cover plate 14 to the upper edge 17 of the clearance 16 has an internal, spherically cup-shaped, concavely curved, undercut recess 26 which thus corresponds to the center disk-shaped segment of a spherical surface, the axis of symmetry of which is the main axis x of the closure device.

A cap lid 19 is inserted into this spherical-surface-segment-shaped recess 26 of the clearance 16 in the area of its upper edge 17, which cap lid 19 is provided with an encircling lid border 20 extending into the clearance.

The outer surface 20*a* of the lid border 20 of the cap lid 19 corresponds to the form of a disk-shaped, center spherical surface segment, the center of curvature 21 of which is located at about half the height of the disk-shaped spherical surface segment on a pivot axis y of the cap lid 19 and the radius of curvature of which approximately corresponds to that of the spherical-surface-shaped recess 26.

A lateral outlet opening 22 is located in the lid border 20 directly beneath the lower side of the cap lid 19 essentially in the upper half of the height of lid border 20. This ensures that, even in its opening position (not shown) in which the outlet opening 22 is located above the upper edge 17 of the closure cap 11, the cap lid is completely sealed relative to the upper edge 17, so that dust or other dirt particles are unable to penetrate between the cap lid 19 and the closure cap 11 into the clearance 16. The all-round tight seating of the outer surface of the lid border 20 in the concave recess 26 of the clearance 16 also ensures that dirt particles which should have deposited onto the outer surface 20*a* of the border 20 of the cap lid in the opening position of the latter are wiped off again in the area of the upper edge 17 of the clearance 16 when the cap lid closes. An essential help here is that the encircling lid border 20 is made elastic in the radial direction and sits with radial pretension against the cap wall 18 of the clearance 16 of the container cap, whereas the cap wall 18 surrounding the recess 16 is made essentially rigid. Therefore, by means of this elastic pretension of the lid border 20 relative to the recess 26 of the clearance 16, a reliable seal of the lid border 20 extending over the entire periphery of the latter is achieved relative to the recess 26. Since an undercut unavoidably results from the spherical-cup-shaped recess 26 of the cap wall 18 of the clearance 16, this ensures that the cap lid 19 inserted into the container cap cannot be lost at the same time as ensuring that it is free to pviot and is sealed relative to the container cap. The frictional resistance between the cap lid and the container cap is essentially always the same, so that irritation for the user caused by changing frictional resistance is impossible.

To ensure the pivotable guidance of the cap lid 19 in the spherical-cup-shaped cap wall of the recess 16, support and pivot means are attached to the underside of the cap lid 19, by means of which support and pivot means the cap lid is supported such that it cannot rotate but can pivot in the closure cap 11 relative to the base of the clearance 16, which base is formed by the cover plate 14. In the embodiment in FIGS. 1 and 2, this support and pivot means consists of a pair of supporting plates 23*a* and 23*b* which extend at a distance from one another parallel to the pivot plane of the cap lid 19 and are supported on the base of the clearance 16, which base is formed by the cover plate 14.

As can be seen from FIG. 2, the free ends 23*c* of the supporting plates 23*a* and 23*b*, which free ends 23*c* sit on the cover plate 14, are made in a circular shape. The center of curvature of the circular free ends 23*c* of the supporting plates 23*a* and 23*b* is located on the pivot axis y of the cap lid 19, with the support point between the curved end 23*c* of the supporting plates 23*a* and 23*b* being located on the center cross-section plane of the closure device on the flat upper side of the cover plate 14 in each position of the cap lid 19, which center cross-section plane is indicated in FIG. 2 by the section line I—I. It can also be seen from FIG. 2 that the supporting plates 23*a* and 23*b*, with a larger part 23*d*, extend from the underside of the cap lid side, used to actuate the cap lid and thus facing away from the outlet opening 22, toward the cover plate 14, but, with a smaller part 23*e*, are also connected to the underside of the cap lid 19, which underside faces toward the outlet opening 22. Therefore the supporting plates 23*a* and 23*b* intercept at right angles the cross-sectional plane running through the pivot axis y of the cap lid 19. At the same time, it can also be seen that the upper side of the cap lid 19 and the lower edge of the encircling, downwardly directed lid border 20 are located in planes which are arranged symmetrically to the pivot axis y, that is, they run parallel to one another in each case at equal distances from the pivot axis y.

To ensure that the cap lid 19 is aligned in its pivot plane, in other words to ensure that the cap lid cannot be turned, guide means are provided for the supporting plates 23*a* and 23*b* of the cap lid 19. In the embodiment according to FIGS. 1 and 2, these guide means consist of a pair of guide ribs 24*a* and 24*b* which are arranged parallel to the pivot axis of the cap lid 19. Each of the two guide ribs 24*a* and 24*b* is in each case arranged tightly against one of the inner sides of the two supporting plates 23*a* and 23*b*, which inner sides are located parallel opposite one another. Because of this seating of the inner surfaces of the support plates 23*a* and 23*b* against the outer surfaces of the guide ribs 24*a* and 24*b*, a sliding guidance of the guide ribs 24*a* and 24*b* and thus of the cap lid 19 in the pivot plane of the latter is consequently ensured and reliably prevents arbitrary or involuntary turning of the cap lid during use of the closure device. Consequently, the pouring-out direction for the free flowing substance of the container is constantly maintained and if necessary can be recognised by the operating person by suitable marks on the cap lid 19.

It can be seen that the supporting plates 23*a* and 23*b* and the guide ribs 24*a* and 24*b* are arranged on diametrically opposite sides of the port hole 15. The main surfaces of the guide ribs 24*a* and 24*b*, which main surfaces extend parallel to the pivot plane of the cap lid 19, are formed in a trapezoidal shape, as shown by FIG. 2, and become narrower in the direction of the cap lid 19, with the guide rib side which forms the smaller angle with the cover plate 14 being located on the side of the cover plate 14 of the clearance 16, which side is used to actuate the cap lid 19. By an essential part of the cross-section of the clearance 16 being filled up in the plane of the guide ribs 24*a* and 24*b* by the latter themselves and by a further part of the cross-section of the clearance being filled up by the supporting plates 23*a* and 23*b* in the area of their planes, the guide ribs and the supporting plates form as it were a guide channel, through which the free flowing substance entering through the port hole 15 from the container into the clearance 16 is effectively guided toward the outlet opening 22.

As can be seen from FIGS. 1 and 2, the spherical-surface-segment-shaped cap wall of the clearance 16 extends to the flat upper side of the cover plate 14 forming the base of the clearance. At the same time, FIG. 1 shows that the flat cover plate, on sections 14*a* and 14*b*, extends from the outer surfaces of the guide ribs 24*a* and 24*b* up to the transition area to the spherical-surface-segment-shaped inner wall over a width which approximately corresponds to the width of the supporting plates 23*a* and 23*b*. Consequently, the outer surfaces of the guide ribs 24*a* and 24*b*, together with the opposite spherical-surface-shaped cap wall of the clearance 16, form a groove-like guide tapering toward the support point of the supporting plates 23*a* and 23*b*, as shown in FIG. 1, which guide prevents lateral deflection of the supporting plates when a heavy pressure is exerted onto the cap lid 19. Consequently, this ensures that, even taking into account the spherical-surface-shaped cross-section of the cap wall for the cap lid 19, even the exertion of high actuating forces cannot impair the accurate position and reliable function of the cap lid.

Moreover, in the clearance 16 of the closure cap 11, a rib-shaped stop 25 for the lower edge of the lid border 20 is provided in the area of the side facing toward the outlet opening 22 beneath the latter when the lid cap 19 is located in the closing position shown in FIG. 2.

The opening position of the lid cap 19, which opening position is not shown in the drawings, is defined by the longer narrow side 24*c* of the trapezoidal shaped supporting plates, which narrow side 24*c* is allocated to the actuating side of the cap lid 19 and against which sits the lower edge of the lid border 20 in the opening position in such a way that the outlet opening 22, with its lower edge, is located directly above the upper edge 17 of the closure cap 11.

This upper edge 17 of the closure cap 11 extends over approximately 180° at the same height on the cap lid side facing toward the outlet opening 22 and is cut out as far as the upper edge, designated 17*a*, and the rear cap lid side used to actuate the cap lid, at a height which is slightly larger than the height of the free cross-section of the outlet opening 22. In this way, a certain limitation of the turning capacity of the cap lid is given when the latter is actuated and at the same time the seal between the cap lid and the spherical-surface-shaped cap wall of the closure cap is maintained.

It can be seen that this first embodiment, shown in FIGS. 1 and 2, of a two piece closure device made of plastic is extraordinarily simple in design and consequently only requires a slight expenditure on tooling with the smallest amount of material usage and, at the same time as having a pleasing appearance, enables the contact surfaces to be completely sealed between the cap lid 19 and the closure cap 11 during simple operation of the cap lid.

Figure 3:
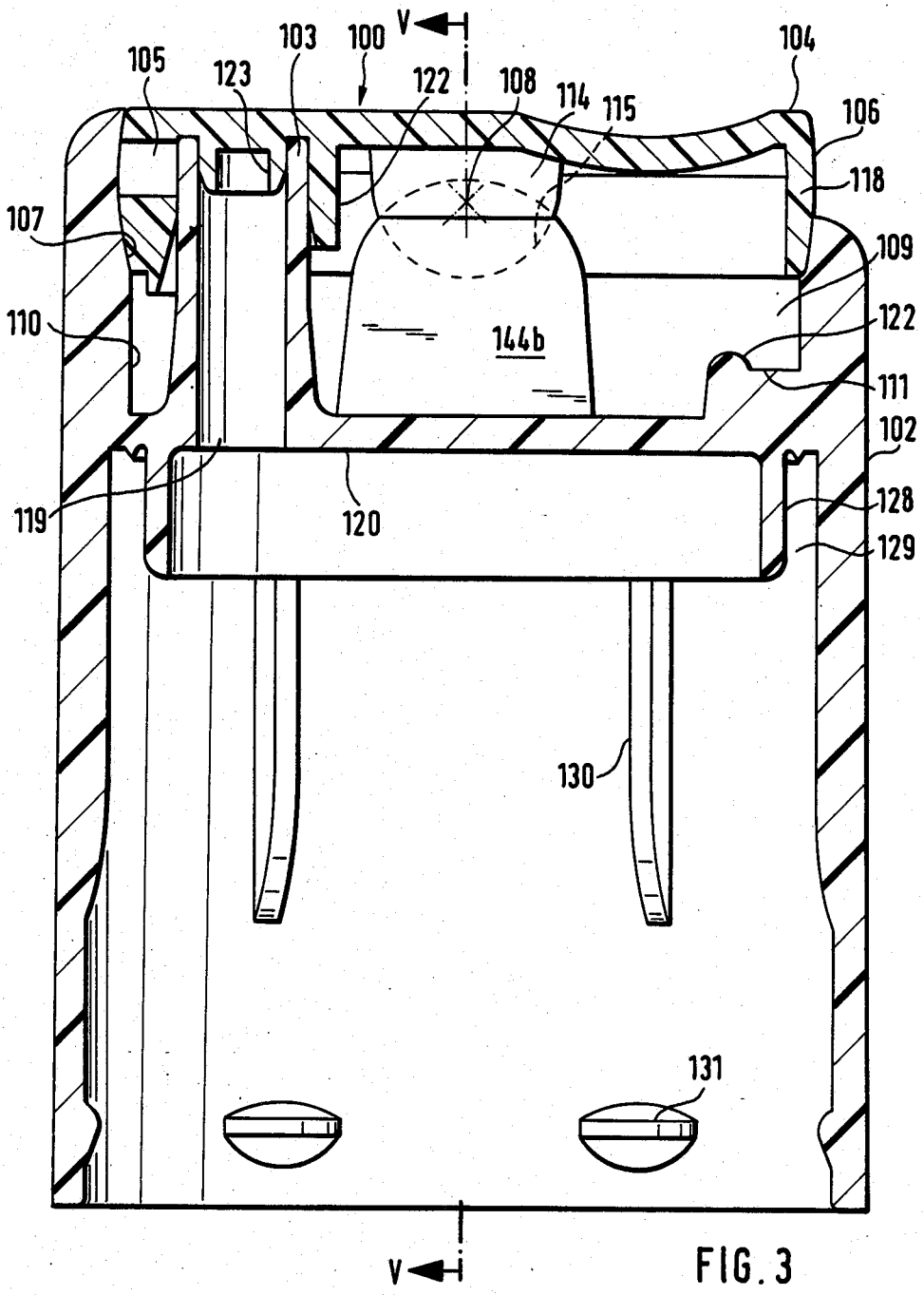
FIG. 3 shows another embodiment of a closure device according to the invention in a center longitudinal section along line III—III in FIG. 5 in the closing position.
Figure 4:
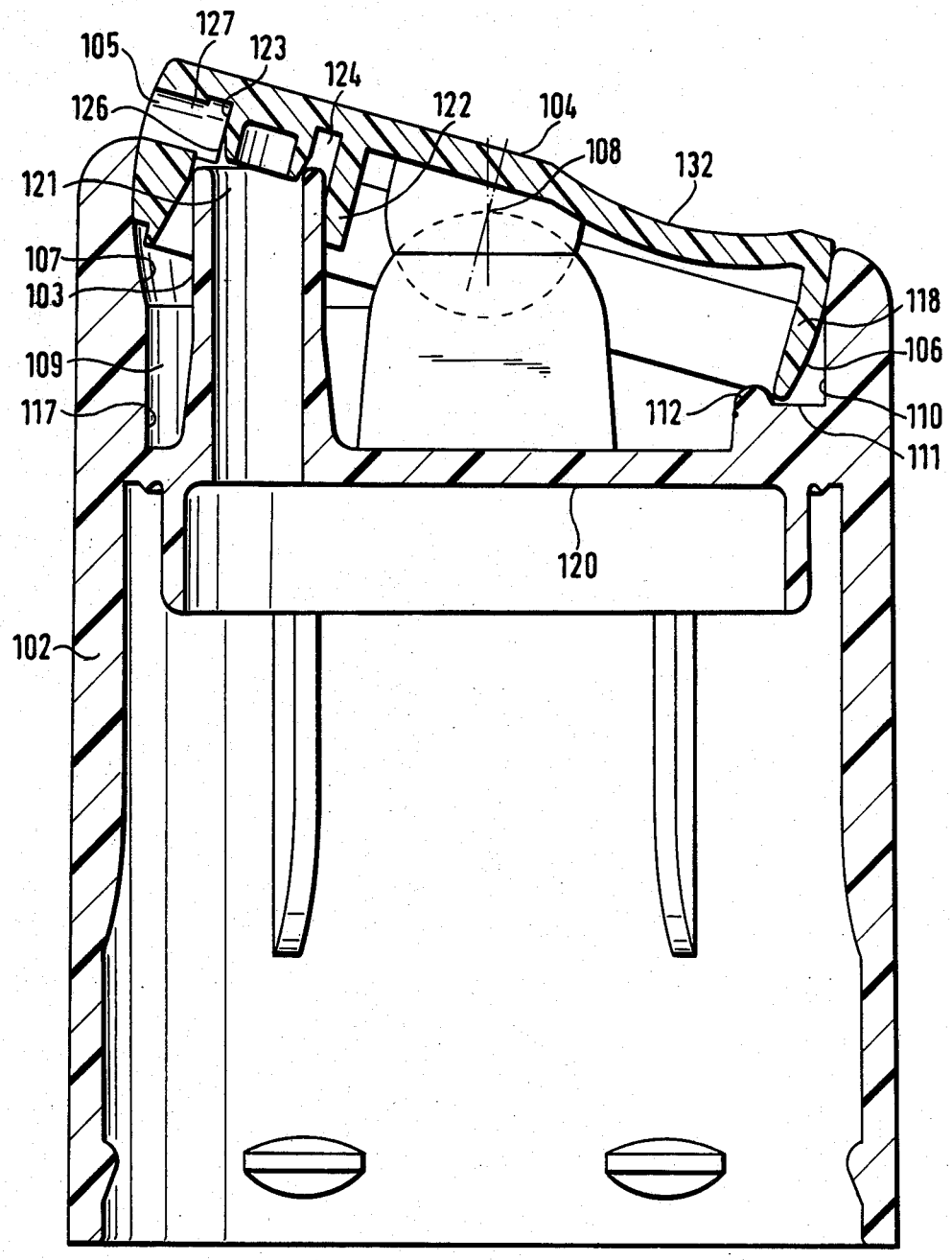
FIG. 4 shows the closure device according to FIG. 3 in the opening position.
Figure 5:
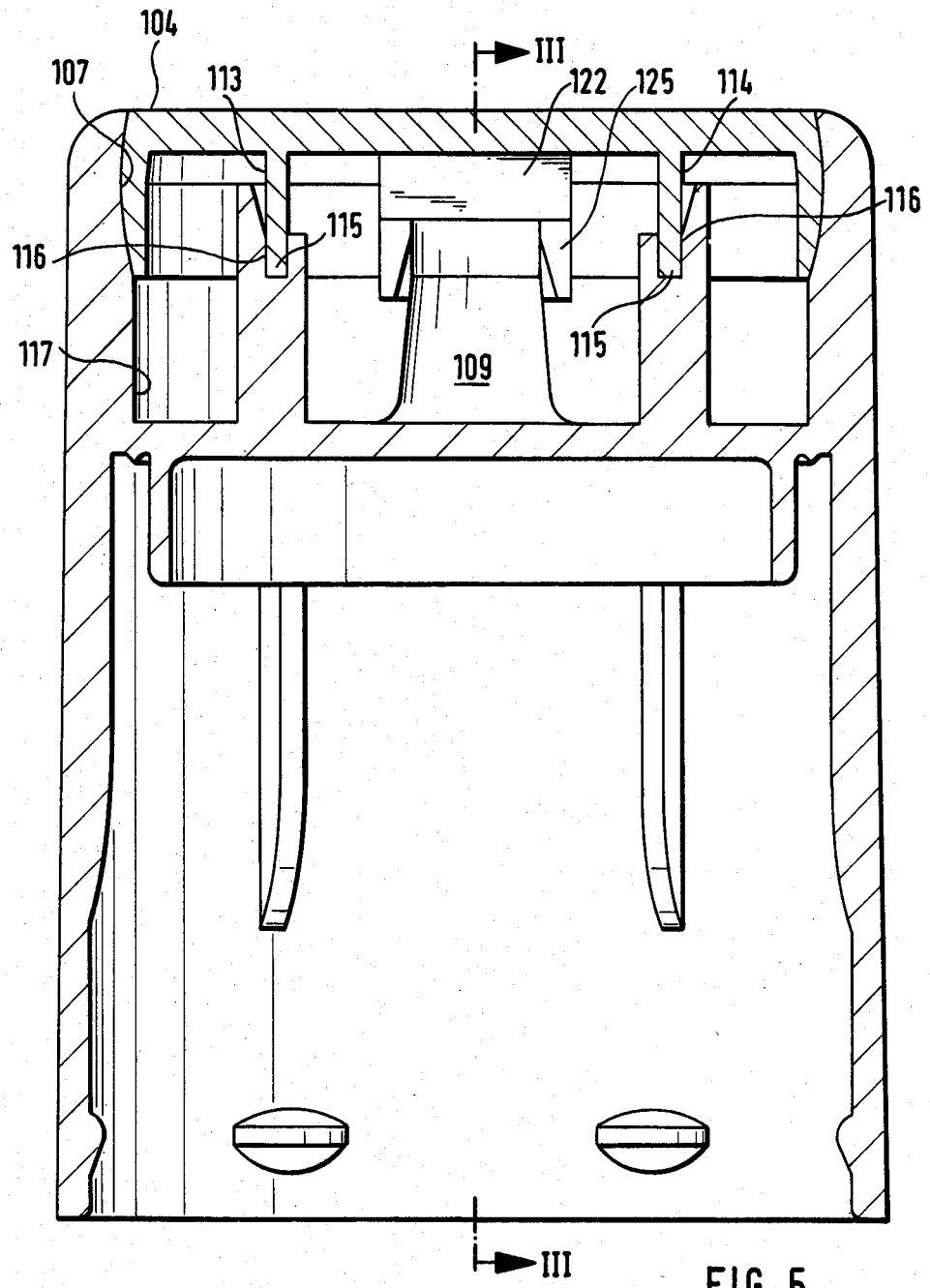
FIG. 5 shows a view of a center longitudinal section along line V—V in FIG. 3.

FIGS. 3, 4 and 5 show a second embodiment of a closure device 100 for a container (not shown), preferably an elastic plastic container. With regard to essential features of the invention, this closure device corresponds to the first embodiment, so that mainly the differences will be dealt with below to avoid repetition. The closure device 100 consists of a closure cap 102, the cap wall of which is provided with longitudinal ribs 130 which, together with click-stop projections 131 attached at a distance below the longitudinal ribs 130 and at angular spacings from one another at the same height, enable the closure cap to be pressed onto the neck surrounding the opening of the container (not shown). As a departure from the illustrated embodiment shown, a screw connection, as in the embodiment in FIGS. 1 and 2, can of course also be provided here between the closure cap and the container neck. An annular groove 129 is provided in the closure cap 102 for the upper end of the container neck, which annular groove 129 is formed by the cap wall of the closure cap and an annular collar projecting downward from a cover plate 120, which annular collar engages as a container plug 128 in a sealing manner into the opening of the container.

In the cover plate 120 is located a port hole 119, above which extends a tube-shaped discharge pipe 103 for the free flowing substance in the container, with the discharge pipe 103 being provided with an upper outlet opening 121.

At the upper end of the closure cap 102 is located a clearance 109, the base of which is formed by the cover plate 120. The clearance 109 is closed at its upper end by a cap lid 104. The cap lid, at its outer periphery, is provided with a lid border 118 projecting into the clearance 109, the outer surface 106 of which lid border 118, as in the embodiment according to FIG. 1 and 2, is convexly curved in accordance with a center, disk shaped spherical surface segment and tightly guided in the cap wall of the closure cap 102 in a concave, inner recess 107 corresponding to this convex curvature. The radius of the convex, encircling outer surface 106 approximately corresponds to its distance from an imaginary pivot axis 108 of the cap lid 104. The curved outer surface 106 and the corresponding recess 107, in the case of a cap lid 104 which is circular in plan view, correspond to a cup-shaped indentation. The pivot axis 108 thus extends at a right angle to the longitudinal axis of a lateral outlet opening 105 in the border 118 of the cap lid 104 and runs about two diametrically opposite, parallel supporting plates 113 and 114. These supporting plates 113 and 114 project perpendicularly downward from the underside of the cap lid 104 and at a distance from one another and, with their circular shaped ends 115, are each pivotably supported in a correspondingly shaped cavity 116 in the underside of guide ribs 144*a* and 144*b* which project perpendicularly upward from the cover plate 120 at a distance from the cap wall 117 of the clearance 109 symmetrically to the main longitudinal axis of the closure device. The radius of the circular shaped cavity 116 and the lower circular shaped ends 115 of the supporting plates 113 and 114 approximately corresponds to the distance which the latter assume relative to the pivot axis 108.

At the underside of the cap lid 104 is located a sealing cap 122 which grips in a sealing manner over the upper outlet opening 121 of the tube-shaped discharge pipe 103 when the cap lid 104 is located in the closing position shown in FIGS. 3 and 5. The underside of the cap lid 104 is concentric inside the sealing cap 122 and is provided with a plug 123 at a radial distance from the sealing cap 122, which plug 123 tightly engages into the opening 121 of the discharge pipe 103, whereas the discharge pipe, with its border surrounding the outlet opening 121, engages into an annular groove 124 formed by the sealing cap 122 and the plug 123. The annular groove 124 is surrounded by a cap wall 125 which grips in a sealing manner over the discharge pipe 103. The cap wall 125 is connected to the outlet opening 105 in the lid border 118 via a radial transfer port 126 and a radial transfer channel 127, adjoining the latter, at the underside of the cap lid 104. The transfer port 126, in the closing position of the cap lid 104, is closed by the discharge pipe 103 engaging into the annular groove 124 between the plug 123 and the cap wall 125. In the opening position of the cap lid 104, the discharge pipe clears the transfer port 126 for connecting with the discharge pipe 103 and the inside of the container.

A stop rib 111 projects into the clearance 109 from the cover plate 120 and inner wall 110 at the side opposite the outlet opening 105 and is provided at its inner end with an upwardly projecting nose 112, so that, as shown in FIGS. 3 and 4, a transverse groove is formed as a seating for the lower edge of the lid border 118 when the cap lid 104 is located in the opening position shown in FIG. 4. The upper end face of the outlet opening 121 of the discharge pipe 103, as shown in FIG. 3, forms the stop for the cap lid 104 in its closing position.

The upper side of the cap lid 104, which upper side is used for actuation, is provided with a cavity 132 for the finger of an operating person to press the cap lid 104 downward and pivot it into the opened position shown in FIG. 4. During this pivot movement, the cap lid 104 is perfectly guided in the cup-like recess 107 of the cap wall 117 of the clearance 109, is centered relative to the pivot axis 108 by the circular shaped bearing surfaces of the ends 115 or cavities 116 and secured against turning about the perpendicular main axis of the closure device. In this opening position, the outlet opening 121 of the discharge pipe 103 is cleared, so that, for example by the exertion of pressure onto the elastic walls of the plastic container, the container contents can discharge through the discharge pipe 103, the transfer port 126 and the transfer channel 127 out of the outlet opening 105, the lower edge of which closes with the upper edge of the cap border. As can be seen, the cap lid 104, even in the opened condition, closes tightly relative to the spherical-cup-shaped recess 107 of the cap wall 117 of the closure cap 102, so that the cap lid 104 is also protected from the ingress of contaminants from the outside during the subsequent pivot movement into the closing position. This protection is ensured in every operating position over the entire periphery of the cap lid relative to the cap wall of the closure cap 102.

It can be seen that the wall of the two piece closure cap 102 made of plastic is also indented deeper here on the side opposite the outlet opening 105. In fact, the upper edge of the closure cap 102, on the side of the pivot axis 108, which side is opposite the discharge opening 105, is bevelled downward at an acute angle to the horizontal, so that, as shown by the figures, the peripheral surface 106 of the cap lid 104 is constantly in sealing enagement with the cap wall of the cap in both the opening and the closing position of the cap lid 104, but pressing downward on this side of the cap lid 104 is facilitated. It can also be seen that the container cap, in the closing position, closes flush at the same height with the upper edge of the upper border of the clearance 109. Also in this second embodiment of the closure device, the lid border 118, in every pivot position, fits over its entire peripheral surface in a uniform sealing manner with elastic radial pretension in the concave, undercut cap wall 117. The frictional resistance which must be overcome to actuate the cap lid is therefore essentially always the same.

What is claimed is:

1. A closure device made of plastic for a container for free-flowing substance, said closure device comprising a cap having a cover plate with a port, and a cap wall extending upwardly from said cover plate, said cap defining an upwardly open recess above said cover plate, and an upper edge at the upper edge of said cap wall, and a closure part, said closure part being pivotably supported about a pivot axis for movement between a closed position and an open position, and wherein one side of the closure part acts as an actuating member and the other side is provided with a laterally disposed outlet opening which, in the closed position of the closure part, is closed by the cap wall, with the closure part side which acts as an actuating member being located in the closed position at a distance above said upper edge, and wherein the closure part comprises a cap lid, said cap lid, at its periphery, having an encircling circumferential border which projects downwardly from said cap lid and into said open recess, the outer surface of said border of said cap lid being a curved spherical surface segment, the center of curvature of which spherical surface segment is located on the pivot axis of said cap lid intermediate the height of said spherical surface segment, and said lateral outlet opening being located beneath the underside of the cap lid and in the upper portion of the height of said encircling lid border, said encircling lid border being sufficiently expansive around said outlet opening to seal against said cap wall below said upper edge, said cap wall, below said upper edge, being provided with an encircling, undercut recess portion formed in a cup-shape complementary to said cap lid border, wherein when the cap lid is inserted into said recess, said cap lid border seats against said cup-shaped recess and is pivotably guided in said cup-shaped recess, and further comprising support and pivot means at the underside of the closure part, by means of which support and pivot means the cap lid is non-rotatably and pivotably suported relative to the recess base, and stop means provided in said recess against which said cap lid rests in its closed and opened positions.

2. The closure device as claimed in claim 1, wherein the upper side of the cap lid and the lower edge of the encircling, downwardly directed lid border lie in planes which run parallel to one another.

3. The closure device as claimed in claim 1, wherein the upper side of the cap lid is concavely curved at least at the side which acts as an actuating member.

4. The closure device as claimed in claim 1, wherein the center of curvature of the spherical surface segment is located on the central longitudinal axis of the closure device.

5. The closure device as claimed in claim 1, wherein the support and pivot means at the underside of the cap lid comprises a pair of parallel supporting plates formed with said cap lid, which plates extend parallel to the pivot plane of the cap lid and which are supported for sliding movement on the base of the recess.

6. The closure device as claimed in claim 5, wherein said supporting plates have free ends, said free ends being curved and resting on the base of the recess.

7. The closure device as claimed in claim 6, wherein said curved free ends are circularly curved, with the center of curvature of said curved ends being located on the pivot axis of the cap lid.

8. The closure device as claimed in claim 5, wherein major portions of the supporting plates extend from the underside of the lid side which acts as an actuating member, and wherein minor portions of the supporting plates extend from the underside of the lid which is provided with the outlet opening.

9. The closure device as claimed in claim 5, wherein guide means for the supporting plates of the cap lid are provided on the base of the recess, said guide means projecting upwardly from said base.

10. The closure device as claimed in claim 9, wherein the guide means comprise a pair of parallel guide ribs, said guide ribs each having an outer side.

11. The closure device as claimed in claim 10, wherein said guide ribs are parallel to each other and a said guide rib is adjacent to an inner side of a supporting plate.

12. The closure device as claimed in claim 10, wherein said port is arranged between the two guide ribs in the center of the cover plate.

13. The closure device as claimed in claim 10, wherein the guide ribs are trapezoidal in shape, with their end edges tapering inwardly and upwardly at different angles from the base of the recess, with the edge forming the smaller angle with the cover plate being located on the side of the recess under which said one side of said closure part is located and serving as a stop for the border of the cap lid in the open position of the latter.

14. The closure device as claimed in claim 10, wherein the outer sides of the guide ribs are trapeziodal-shaped and at their bases at the closest point to the spherical surface segment are at a distance which approximately corresponds to the thickness of a supporting plate.

15. The closure device as claimed in claim 1, wherein said base has a flat recess and said undercut recess portion continues as far as the flat base of the recess.

16. The closure device as claimed in claim 1, wherein said stop means for the border of the cap lid in the closed position of the cap lid is provided on the cap wall, said stop means being located beneath the outlet opening.

17. The closure device as claimed in claim 1, wherein said support and pivot means comprise supporting plates having circularly-shaped ends and a pair of guide ribs which project upward from said cover plate, said guide ribs defining cavities which are complementary to said ends for receiving said ends.

18. The closure device as claimed in claim 1, wherein said stop means for the cap lid in the closed position comprises a discharge pipe in said cap defining the port in the cover plate, and a sealing cap and a closure plug formed at the underside of the cap lid, which closure plug is concentric with the sealing cap, said plug and said cap forming an axial annual groove for receiving the upper end of the discharge pipe in the closed position of the cap lid.

19. The closure device as claimed in claim 18, wherein said sealing cap defines a radial transfer channel with said discharge pipe, said transfer channel being closed by the upper end of the discharge pipe in the closed position of the cap lid.

* * * * *